US005667530A

United States Patent [19]

Benasra

[11] Patent Number: 5,667,530

[45] Date of Patent: Sep. 16, 1997

[54] FROSTED TERRY CLOTH AND METHOD FOR PRODUCING SAME

[76] Inventor: Michel Benasra, 1405 Bluebird Ave., Los Angeles, Calif. 90069

[21] Appl. No.: 679,669

[22] Filed: Jul. 12, 1996

Related U.S. Application Data

[63] Continuation of Ser. No. 264,636, Jun. 23, 1994, abandoned.

[51] Int. Cl.[6] ..... D06L 3/02; D06L 3/16; D06L 3/14

[52] U.S. Cl. ..... 8/102; 8/107; 8/111; 510/302; 510/303; 510/309

[58] Field of Search ..... 8/102, 111, 107, 8/110, 115, 137; 510/302, 303, 309

[56] References Cited

U.S. PATENT DOCUMENTS

| | | | |
|---|---|---|---|
| 3,847,542 | 11/1974 | Harper, Jr. et al. | 8/482 |
| 3,951,594 | 4/1976 | Smolens | 8/111 |
| 4,740,213 | 4/1988 | Ricci | 8/108.1 |
| 4,900,323 | 2/1990 | Dickson et al. | 8/111 |
| 4,961,751 | 10/1990 | Eissele et al. | 8/111 |
| 5,190,562 | 3/1993 | Dickson et al. | 8/111 |
| 5,215,543 | 6/1993 | Milora et al. | 8/111 |

FOREIGN PATENT DOCUMENTS 339674 11/1989 European Pat. Off. .

OTHER PUBLICATIONS

Bazin, J. et al., 2073 TPI Textil Praxis International 47, No. 10, Leinfelden–Echterdingen, Germany Oct. 1992.

Bazin, J. et al., 2073 TPI Textil Praxis International 47 (1992) Oct., No. 10,Leinfelden–Echterdingen, Germany.

*Primary Examiner*—Alan D. Diamond

*Attorney, Agent, or Firm*—Jeffer, Mangels, Butler & Marmaro LLP

[57] ABSTRACT

A terry cloth article having a frosted appearance includes a plurality of naps the tips of which are bleached, and is produced by a process including the steps of impregnating granules of an absorbent material with a solution including a bleaching agent, and contacting a dyed terry cloth with the granules for a time sufficient to bleach at least a portion of the dye from the naps of the terry cloth. After residual bleaching agent remaining on the terry cloth is neutralized, the terry cloth is subsequently contacted with a solution including an effective amount of an anti-peeling agent for a time sufficient to substantially eliminate peeling. Optionally the terry cloth can subsequently be overdyed with a second dye of a different color than the color of the terry cloth.

32 Claims, No Drawings

FROSTED TERRY CLOTH AND METHOD FOR PRODUCING SAME

This application is a continuation of application Ser. No. 08/264,636, filed Jun. 23, 1994 now abandoned.

Field of the Invention

The present invention relates to a method for processing terry cloth to produce a "frosted" appearance, and to an article, such as a towel, produced according to the method.

Background of the Invention

In the processing of fabrics and garments, more particularly garments made from durable fabrics such as denim, considerable effort has been expended in producing a "used" look, also known as s "faded" look. This fashionable appearance is produced by a number of methods. Early efforts involved the use of bleaching agents such as salts of hypochlorous acid, particularly sodium hypochlorite. These agents uniformly bleach fabrics.

Later methods sought to produce a look featuring random faded effects. For example, the "stone-washing" method relies on abrasion of the fabric by a hard substance. The fabric to be treated is washed with a selected amount of natural or synthetic stones, particularly pumice.

An improvement in the stone-washing process is disclosed in U.S. Pat. No. 4,740,213, to Ricci. Ricci tumbles a cloth, in the dry state, in the presence of pumice or a similar material which is impregnated with a bleach. Ricci, however, is concerned primarily with treating denim garments.

Other methods end materials for producing "stone washed" or faded garments, particularly denim garments, are disclosed in U.S. Pat. No. 5,190,562, to Dickson et el.; U.S. Pat. No. 5,215,543, to Milora et el.; and U.S. Pat. No. 5,298,027, to Kuno et el.

Terry cloth is a fabric comprised of a plurality of "naps" which produce the characteristic appearance and texture of the fabric. Unlike denim and other fabrics useful in producing durable garments, terry cloth is a delicate fabric which is used primarily to produce towels, bathrobes and other household articles. It is believed that processing methods applicable to durable fabrics such as denim heretofore have not been considered appropriate for or applicable to terry cloth. Use of large, heavy stones such as large pumice stones, for example, can lead to destructive abrasion of the naps. High temperatures or other harsh bleaching conditions can likewise adversely affect terry cloth. Terry cloth is also subject to "peel," that is, unraveling and loss of naps. In order to produce the fashionable "faded" or "frosted" look in a terry cloth article, such as a towel, robe, etc., new techniques are needed.

It would therefore be desirable to provide a method for producing a "frosted" terry cloth article which can be carried out without destructive abrasion or peeling.

SUMMARY OF THE PREFERRED EMBODIMENTS

In accordance with one aspect of the present invention, there has been provided a "frosted" terry cloth article comprising a plurality of naps, the tips of which are bleached. According to a preferred embodiment, the tips of substantially all of the naps of the terry cloth article are bleached.

In accordance with another aspect of the present invention, a terry cloth article is provided comprising a plurality of naps, the tips of which are of a different color than the remainder of the naps.

In accordance with a further aspect of the present invention, there has been provided a method of treating a dyed terry cloth to produce a frosted appearance which comprises the steps of: impregnating granules of an absorbent material with a solution comprising a bleaching agent; contacting the terry cloth with the granules for a time sufficient to bleach at least a portion of the dye from the naps of the terry cloth; neutralizing any residual bleaching agent remaining on the terry cloth; and contacting the terry cloth with a solution comprising an effective amount of an anti-peeling agent for a time sufficient to substantially eliminate peeling.

In a more specific aspect of the present invention, the terry cloth is tumbled with pumice granules, preferably having a diameter from about 0.25 to about 1 inch, which are impregnated with a potassium permanganate solution.

In a more preferred embodiment, the anti-peeling agent is an enzymatic anti-peeling agent.

Preferably, after the tumbling step the terry cloth is dried and cleaned to remove residual particles of the absorbent material. Also preferably, after the neutralization step the terry cloth is rinsed.

In accordance with still another aspect of the present invention, there is provided a terry cloth article produced by the method described above.

Other objects, features and advantages of the present invention will become apparent to those skilled in the art from the following detailed description. It is to be understood, however, that the detailed description and specific examples, while indicating preferred embodiments of the present invention, are given by way of illustration and not limitation. Many changes and modifications within the scope of the present invention may be made without departing from the spirit thereof, and the invention includes all such modifications.

DETAILED DESCRIPTION OF THE PREFERRED EMBODIMENTS

Applicants have unexpectedly discovered that a novel method can be applied to delicate terry cloth articles, such as towels, to produce the desired "frosted" appearance.

As used herein, the term "frosted" denotes a partial bleaching of the terry cloth, more specifically, a bleaching of the tips of the naps of the terry cloth fabric without substantial bleaching of the bases of the naps. The "tips" of the naps are the free ends of the naps, and can be defined as at least the top 0.1 to 0.3 cm of the naps. The remainder of the naps, the "bases," are in contact with the remainder of the fabric. Preferably the tips of the naps of at least a portion of the terry cloth fabric are bleached. By "at least a portion" is meant at least one localized area on at least one surface of the terry cloth. Localized bleaching can be achieved by use of a short tumbling step. More preferably, the tips of substantially all, very preferably at least 90%, of the naps are bleached, producing a uniform "frosted" appearance over substantially all of at least one surface of the terry cloth.

Any type of terry cloth fabric can be treated according to the instant method. Preferably, the terry cloth fabric has naps on both sides of the fabric. Other types of terry cloth, e.g., "velvet" type terry cloths having naps on only one side, can also be treated according to the inventive method.

Prior to the "frosting" process of the instant invention, the terry cloth fabric may be dyed to the desired color. Any known dyes suitable for use with terry cloth can be used. Preferred dyes include the so-called "direct" dyes. Conventional terry cloth dyeing processes can be employed to produce the dyed terry cloth to be treated according to the instant invention.

In the first step of a method according to the instant invention, granules of an absorbent material are impregnated with a solution comprising a bleaching agent. The granules can be of any absorbent material suitable for use in "acid wash" or "stone wash" processes. Preferably, pumice is employed as the absorbent material. The granules employed in the inventive process preferably have a maximum diameter of about 1 inch, particularly a diameter from about 0.25 inch to 1 inch. The diameter of the granules is measured according to conventional methods, such as the use of a sieve. Use of granules larger than about 1 inch in diameter, especially granules of a relatively coarse material such as pumice, may result in damage to the fabric through excessive abrasion, formation of "spots" in the cloth and destruction of the naps of the fabric. Use of granules smaller than about 1 inch in diameter results in a more uniform "frosted" appearance without damage to the fabric.

Preferably, the bleaching agent used to impregnate the granules is potassium permanganate. Other known bleaching agents can also be used if desired. The bleaching agent preferably is used in a concentration not greater than about 2% by weight, more preferably about 1% to 2% by weight. Higher concentrations of the bleaching agent may damage the delicate fabric.

The granules employed in the inventive process preferably are impregnated with the bleaching agent by wetting with a solution, preferably a cold water solution, comprising the bleaching agent. The wetting can be accomplished by any desired method, such as spraying the granules, soaking them in the solution, etc.

In the next step according to the inventive method, the dyed terry cloth fabric to be treated is contacted with the impregnated granules. In a preferred embodiment, the contacting is carried out by tumbling the fabric in the presence of the impregnated granules. The contacting can also be carried out in ways other than tumbling, for example by agitation of a layer of granules over the fabric, such as by shaking in a frame in which the fabric is stretched.

According to an exemplary embodiment, a conventional tumbling machine is loaded with 40 lbs. of granules and 10 lbs. of fabric. The contacting step, here the tumbling step, preferably is carried out for a time less than about 20 minutes, particularly about 15 to about 20 minutes. Tumbling for more than about 20 minutes may have an adverse effect on the appearance of the fabric, including destruction of the edges of the fabric. Tumbling for less than about 15 minutes may result in non-uniform bleaching; however, if a more random frosted appearance is desired, such shorter tumbling times can be employed. Preferably the tumbling process is checked periodically, for example approximately every 5 minutes, in order to prevent bunching of the fabric and the formation of "hot spots" on the fabric due to excessive localization of granules.

The tumbling step is preferably carried out at ambient air temperature.

The granule/fabric ratio for the tumbling step can be any conventional ratio, for example, 40 lbs. granules to 10 lbs. fabric as discussed above.

In a preferred embodiment of the inventive method, the terry cloth fabric is dried after the tumbling step. It is important that the fabric is dried at this point, prior to the neutralization step, in order to achieve the most attractive, uniform final appearance. The drying is preferably carried out at a low temperature. High temperatures will result in discoloration of the fabric (e.g., fading). In particular, the drying can be carried out at ambient temperature, such as by air-drying on a line or on a flat surface exposed to the atmosphere (e.g, on the ground).

The drying step preferably is carried out for a time between about 15 minutes and about 20 minutes. Longer drying times may result in "peeling" of the terry cloth fabric (i.e., detachment of threads and naps from the surface of the fabric) and loss of nap, while shorter drying times will result in insufficient drying of the fabric.

Also prior to the neutralization step, the treated fabric preferably is cleaned to remove dust, particles, fragments of the impregnated granules, etc. This cleaning step is important in order to prevent bleaching of the bases of the naps, which also results in a less uniform appearance in the finished fabric, which may be considered less than optimal unless a more random or "blotched" appearance is desired. Preferably, the cleaning step is carried out after the drying step, in order to remove additional dust particles, etc., that may have adhered to the fabric during the drying step. If desired, cleaning and drying can be carried out in another order, or simultaneously.

After drying and cleaning, and in any event subsequent to the tumbling step, the terry cloth fabric is subjected to a neutralization step to neutralize any residual bleaching agent remaining on the fabric. The neutralizing step is preferably carried out by contacting the terry cloth with a solution comprising a neutralizing agent. Selection of a neutralizing agent will depend on the type of bleaching agent used. For example, when potassium permanganate is used as the bleaching agent, a preferred neutralizing agent is sodium metabisulfite. Other neutralizing agents can be used if desired.

The terry cloth fabric can be contacted with the solution comprising the neutralizing agent in any desired way, such as soaking, spraying, etc. Preferably the terry cloth fabric is soaked in the neutralizing agent solution for about 15 to about 20 minutes.

In a preferred embodiment of the inventive method, the treated terry cloth fabric is rinsed after the neutralization step to remove residual neutralizing agent and any other impurities, particles, contaminants, etc. which may be present. The rinsing is preferably carried out using cool or cold water. Use of hot water can result in peeling. For example, the terry cloth fabric can be rinsed twice in cold water for about 4 to 5 minutes per rinse. Rinsing times greater than 5 minutes can result in peeling and loss of nap, while rinsing times less than 4 minutes may not clean the fabric sufficiently.

The terry cloth fabric is then contacted with e solution comprising an effective amount of an anti-peeling agent. It is important to treat the fabric with an anti-peeling agent at this point in order to obtain an article having the desired frosted appearance.

Preferred anti-peeling agents are enzymatic anti-peeling agents. Particularly preferred is SUPERSOFT NC™ a multifunctional enzyme concentrate commercially available from Deezee Co. (Paramount, Calif.).

In carrying out the anti-peeling step, preferably a solution is prepared comprising the selected anti-peeling agent. Preferably the solution comprises about 4% to about 5% of the anti-peeling agent in warm water, i.e., water at a temperature of about 110° F. to about 120° F. A greater amount of anti-peeling agent is used at a lower temperature, for example, 5% at 110° F.

In one embodiment of the inventive process, the terry cloth fabric is placed in a washing machine to which the warm water is added. The anti-peeling agent is then added to the water to form the solution.

In a preferred embodiment, an acid is added to the anti-peeling solution. For example, acetic acid can be added to the solution in an amount of about 0.5%. The addition of acid adjusts the pH of the solution for optimal enzyme activity.

The fabric is contacted with the anti-peeling agent solution for a time sufficient to substantially eliminate peeling. Typically, the fabric is contacted with the solution for about 20 to about 30 minutes. Contact for longer than about 30 minutes can adversely affect the color of the finished fabric, while contact for less than about 20 minutes may be insufficient to substantially eliminate peeling.

Preferably, after the foregoing anti-peeling treatment, the terry cloth fabric is then rinsed in cold water. At this point, optionally the fabric can be rinsed in a cold water solution comprising a softener, preferably a cationic softener, for about 5 to 10 minutes. A fragrance can be added as well, if desired, or can be added to the fabric at a later stage, such as by spraying.

At this point, whether or not the terry cloth fabric has been treated with the optional softener and/or fragrance, the fabric preferably is dried for about 30 to about 40 minutes at a temperature of about 140° F. to about 150° F. Higher temperatures should be avoided in order not to adversely affect the appearance of the fabric.

The finished terry cloth fabric has the desired "frosted" appearance and has excellent softness, luxury and color contrast. Typically, the tips of the naps are bleached over the top 0.1 to 0.3 cm, preferably 0.1 to 0.2 cm.

Optionally, the terry cloth can be subjected to an additional dyeing step ("overdyeing") subsequent to the initial "frosting" step. For example, a terry cloth fabric initially dyed red is "frosted" as described above. After the anti-peeling step, the fabric is then overdyed using a yellow dye. The resulting terry cloth fabric is "frosted" with yellow rather than white, while the nap bases retain the original red color. This embodiment of the invention affords a wide variety of color combinations for production of fabrics having different attractive appearances.

The terry cloth fabric produced according to the invention can be used in the manufacture of articles such as towels, bathrobes, carpets, etc.

The present invention is further illustrated by way of the following non-limiting example. All percentages are by weight.

EXAMPLE

A terry cloth fabric is dyed according to the following process. The fabric is loaded into a washing machine and rinsed at a temperature of 120°–140° F. for 5 minutes. After adding 1% of scour 50 (a cleaning agent which prepares fabrics for dyeing, available from Deezee Co.) the water is drained from the machine.

Next, hot water at 160° F. is loaded with 5% salt. Then the following dyes are added: 1% Black Supra, 1% Blue ARL and 1% Navy Blue Her. The machine is run for 30 minutes, and the water is then drained. The terry cloth fabric is rinsed twice with cold water, then spinned and dried at 190° F.

| | |
|---|---|
| 1) potassium permanganate | 5 lb |
| cold water | 10 gal |
| 2) sodium metabisulfite | 5 lb |
| cold water | 20 gal |

The granules are next prepared for tumbling with the terry cloth fabric. Forty (40) pounds of pumice stones having a diameter of about 1 inch are wetted with solution 1. The wetted stones are placed in a conventional tumbling machine and tumbled for 2–3 minutes. Then, ten (10) pounds of the terry cloth fabric are added into the tumbler and tumbled for 15–20 minutes. The fabric is checked periodically to prevent bunching. After tumbling is completed, the fabric is removed from the tumbler and air-dried for 15–20 minutes, and then cleaned to remove dust and pumice particles.

Next, the dried fabric is placed in a washer with solution 2 for 15–20 minutes. The fabric is then removed from solution 2 and rinsed twice in cold water for 4–5 minutes per rinse.

Warm water (120° F.) is next loaded into the washer at a low level. Acetic acid is added to the water in an amount of 0.5%. Then 4% of SUPERSOFT NC™ multifunctional enzyme concentrate is added, and the washer is run for 30 minutes. The solution is drained from the washer and the fabric is re-rinsed once in cold water. A softener is added with cold water, and the washer is run for about 5 minutes.

Finally, the fabric is dried at 150° F. for about 30–40 minutes. A frosted terry cloth fabric is produced which is free of peeling and is very soft.

What is claimed is:

1. A method of treating a dyed terry cloth to produce a frosted appearance which comprises the steps of:

(a) impregnating granules of an absorbent material with a solution comprising a bleaching agent; and (b) contacting the terry cloth with the granules for a time sufficient to bleach at least a portion of the dye from the naps of the terry cloth.

2. A method of treating a dyed terry cloth to produce a frosted appearance which comprises the steps of:

(a) impregnating granules of an absorbent material with a solution comprising a bleaching agent;

(b) contacting the terry cloth with the granules for a time sufficient to bleach at least a portion of the dye from the naps of the terry cloth;

(c) neutralizing any residual bleaching agent remaining on the terry cloth; and (d) contacting the terry cloth with a solution comprising an effective amount of an anti-peeling agent for a time sufficient to eliminate peeling.

3. The method of claim 2 wherein in step (b) the contacting is carried out by tumbling the terry cloth in the presence of the granules,

4. The method of claim 2 wherein the absorbent material is pumice.

5. The method of claim 2 wherein the granules have a maximum diameter of about 1 inch.

6. The method of claim 5 wherein the granules have a diameter from about 0.25 inch to about 1 inch.

7. The method of claim 2 wherein the bleaching agent is potassium permanganate,

8. The method of claim 7 wherein the granules are impregnated by wetting with a solution of about 1% to 2% by weight potassium permanganate in water.

9. The method of claim 2 wherein in step (b) the terry cloth is tumbled in the presence of the granules for about 15 to about 20 minutes.

10. The method of claim 2 wherein in step (b) the terry cloth is contacted with the granules at ambient air temperature.

11. The method of claim 2 wherein after step (b) the terry cloth is dried.

12. The method of claim 11 wherein the terry cloth is dried at ambient temperature.

13. The method of claim 12 wherein the terry cloth is air-dried.

14. The method of claim 12 wherein the terry cloth is dried for about 15 to about 20 minutes, 15. The method of claim 2 wherein after step (b) the terry cloth is cleaned to remove any residual particles of the absorbent material.

16. The method of claim 2 wherein in step (c) the neutralization is effected by contacting the terry cloth with a solution comprising a neutralizing agent.

17. The method of claim 16 wherein the neutralizing agent is sodium metabisulfite.

18. The method of claim 16 wherein the terry cloth is contacted with the solution in step (c) for about 15 to about 20 minutes.

19. The method of claim 2 wherein after step (c) the terry cloth is rinsed.

20. The method of claim 19 wherein the terry cloth is rinsed with cold water.

21. The method of claim 20 wherein the terry cloth is rinsed twice in water for about 4 to about 5 minutes per rinse.

22. The method of claim 2 wherein in step (d) the solution comprises about 4% to about 5% by weight of the anti-peeling agent in water at a temperature of about 110° F. to about 120° F.

23. The method of claim 22 wherein the solution in step (d) further comprises an acid.

24. The method of claim 23 wherein the solution in step (d) contains about 0.5% by weight acetic acid.

25. The method of claim 2 wherein in step (d) the terry cloth is contacted with the solution for about 20 to about 30 minutes.

26. The method of claim 2 wherein the terry cloth is rinsed in cold water after step (d).

27. The method of claim 2 further comprising the step (e) of contacting the terry cloth with a solution comprising water and a cationic softener.

28. The method of claim 27 wherein in step (e) the terry cloth is contacted with the solution for about 5 to about 10 minutes.

29. The method of claim 27 wherein the solution in step (e) further comprises a fragrance.

30. The method of claim 2 further comprising the step (f) of drying the terry cloth at about 140° F. to about 150° F. for about 30 to about 40 minutes.

31. The method of claim 2 wherein subsequent to step (d) the terry cloth is overdyed with a dye of a color different from the color of the terry cloth.

32. A method of treating a dyed terry cloth to produce a frosted appearance which comprises the steps of:

(a) impregnating granules of pumice having a diameter of about 0.25 inch to about 1 inch with a solution comprising potassium permanganate;

(b) tumbling the terry cloth in the presence of the impregnated pumice granules for about 15 to about 20 minutes;

(c) drying the terry cloth at ambient temperature;

(d) cleaning the terry cloth to remove residual pumice particles;

(e) neutralizing residual potassium permanganate remaining on the terry cloth by contacting the terry cloth with a solution of sodium metabisulfite for about 15 to about 20 minutes;

(f) rinsing the terry cloth in water; and (g) contacting the terry cloth with a solution comprising about 4% to about 5% by weight of an enzymatic anti-peeling agent in water at a temperature of about 110° F. to about 120° F. for about 20 to about 30 minutes.

* * * * *